US010512333B2

(12) United States Patent
Lawson et al.

(10) Patent No.: US 10,512,333 B2
(45) Date of Patent: Dec. 24, 2019

(54) LOW-PROFILE, ZERO GRAVITY, ALL-LINKAGE SEAT MECHANISM WITH ADDED BACK RECLINE

(71) Applicant: L&P PROPERTY MANAGEMENT COMPANY, South Gate, CA (US)

(72) Inventors: Gregory Mark Lawson, Tupelo, MS (US); Cheston Brett Crawford, Randolph, MS (US)

(73) Assignee: L&P Property Management Company, South Gate, CA (US)

( * ) Notice: Subject to any disclaimer, the term of this patent is extended or adjusted under 35 U.S.C. 154(b) by 0 days.

(21) Appl. No.: 15/928,339

(22) Filed: Mar. 22, 2018

(65) Prior Publication Data

US 2019/0290004 A1 Sep. 26, 2019

(51) Int. Cl.
*A47C 1/0355* (2013.01)
*A63J 25/00* (2009.01)
*A47C 1/121* (2006.01)

(52) U.S. Cl.
CPC ..... *A47C 1/0355* (2013.01); *A47C 1/121* (2013.01); *A63J 25/00* (2013.01)

(58) Field of Classification Search
CPC ..... A47C 1/035; A47C 1/0355; A47C 1/121; A63J 25/00
See application file for complete search history.

(56) References Cited

U.S. PATENT DOCUMENTS 5,374,101 A * 12/1994 Wiecek ..... A47C 1/0355 297/75
5,772,278 A * 6/1998 Kowalski ..... A47C 1/0355 297/85 L
5,800,010 A * 9/1998 May ..... A47C 1/0355 297/84
5,971,475 A * 10/1999 Lawson ..... A47C 1/0355 297/68
6,135,559 A * 10/2000 Kowalski ..... A47C 1/024 297/301.5
6,634,706 B2 * 10/2003 May ..... A47C 1/0355 297/270.1
8,398,165 B2 * 3/2013 Lawson ..... A47C 3/027 297/259.2
8,419,122 B2 * 4/2013 Lawson ..... A47C 1/035 297/259.2
8,573,687 B2 * 11/2013 Lawson ..... A47C 1/0355 297/84
9,585,477 B2 * 3/2017 Huang ..... A47C 1/0355
9,839,297 B2 * 12/2017 Lawson ..... A47C 7/506
2011/0181094 A1 7/2011 Lawson et al.
(Continued)

OTHER PUBLICATIONS

International Search Report and Written Opinion dated May 14, 2019 in International Patent Application No. PCT/US2019/022907, 7 pages.

*Primary Examiner* — Philip F Gabler
(74) *Attorney, Agent, or Firm* — Shook, Hardy & Bacon L.L.P.

(57) ABSTRACT

A chair mechanism is provided for a seating unit that has a footrest, a seat, and a back. The mechanism is adapted to move the seating unit from a closed position with the footrest stowed beneath the seat, the seat in a generally horizontal orientation, and the back in an upright position, to an extended position with the footrest extended, the seat inclined from back-to-front, and the back in a reclined position.

18 Claims, 6 Drawing Sheets

(56) References Cited

U.S. PATENT DOCUMENTS

| | | | | |
|---|---|---|---|---|
| 2014/0333099 | A1 | 11/2014 | Lu et al. | |
| 2016/0045031 | A1* | 2/2016 | Lawson | A47C 1/0345<br>297/284.3 |
| 2017/0332787 | A1 | 11/2017 | Brandhuber | |
| 2018/0027968 | A1* | 2/2018 | Lawson | A47C 1/03211 |
| 2018/0064255 | A1* | 3/2018 | Lawson | A47C 1/035 |

* cited by examiner

LOW-PROFILE, ZERO GRAVITY, ALL-LINKAGE SEAT MECHANISM WITH ADDED BACK RECLINE

TECHNICAL FIELD

Embodiments of the present invention relate to recliner seating mechanisms and chairs using them, and particularly to a recliner seating mechanism for use on a theater chair with an ottoman, seat, and back that can be positioned in a desired zero-gravity configuration.

BACKGROUND OF THE INVENTION

In the motion furniture industry, mechanisms exist to move a chair between at least two positions: a closed position, with a footrest stowed and the chair back substantially upright; and a fully reclined position with the footrest extended, the chair seat inclined from the back to the front, and the back reclined (what is known as a "zero-gravity" position). This type of motion is now making its way into other environments, such as movie theaters or cinemas. However, these commercial environments present new problems for this type of motion furniture. It would be advantageous to have a design adapted for the challenges presented by these environments. Additionally, seating units exist that provide a reclined, zero-gravity position, but do so with a seat back that is fixed relative to the seat itself. Some users might prefer a similar seating unit, but one that reclines the back slightly, relative to the seat, when the seating unit moves to the zero-gravity extended position.

BRIEF DESCRIPTION OF THE INVENTION

A chair mechanism is provided for a seating unit that has a footrest, a seat, and a back. The mechanism is adapted to move the seating unit from a closed position with the footrest stowed beneath the seat, the seat in a generally horizontal orientation, and the back in an upright position, to an extended position with the footrest extended, the seat inclined from back-to-front, and the back in a reclined position. The mechanism includes a pair of spaced apart first and second base plates that are coupled together in spaced relation. The seating unit has a pair of mechanisms operable to move the seating unit between the closed position and the extended position, with one mechanism coupled to each base plate. Each mechanism is a mirror-image of the other. Each mechanism has a seat plate pivotally coupled to a corresponding base plate with a first linkage that moves the seat plate between a first position when the seating unit is in the closed position and a second position when the seating unit is in the extended position. Each mechanism further includes a back mounting link that is pivotally coupled to the seat plate and to a second linkage that reclines the back mounting link from a first, upright position when the seating unit is in the closed position to a second, reclined position when the seating unit is in the extended position. In the reclined position, the back mounting link is reclined slightly relative to the seat plate to provide a different recline position as compared to a seating unit where the back is fixed relative to the seat. A footrest linkage is pivotally coupled to the seat plate that moves the footrest from a stowed position when the seating unit is in the closed position to an open position when the seating unit is in the extended position. A third linkage is coupled to the footrest linkage that moves the footrest linkage between the stowed position and the open position. A bell crank is pivotally coupled to the seat plate. The bell crank has a first section extending in a first direction from the pivotal connection with the seat plate, and a second section extending in a second direction from the pivotal connection with the seat plate. The first section of the bell crank is pivotally connected to a link in the third linkage, and the second section is pivotally connected to a link in the third linkage and to a link in the second linkage. The bell crank controls (directly or indirectly) the extended position of the footrest and the reclined position of the back.

Additional objects, advantages, and novel features of the invention will be set forth in part in the description that follows, and in part will become apparent to those skilled in the art upon examination of the following, or may be learned by practice of the invention.

BRIEF DESCRIPTION OF SEVERAL VIEWS OF THE DRAWINGS

The present invention is described in detail below with reference to the attached drawing figures, wherein.

DETAILED DESCRIPTION OF THE INVENTION

Embodiments of the present invention generally relate to a chair mechanism for a seating unit (and a seating unit incorporating the chair mechanism) that has a footrest, a seat, and a back. The mechanism is adapted to move the seating unit from a closed position with the footrest stowed beneath the seat, the seat in a generally horizontal orientation, and the back in an upright position, to an extended position with the footrest extended, the seat inclined from back-to-front, and the back in a reclined position. The mechanism includes a pair of spaced apart first and second base plates that are coupled together in spaced relation. The seating unit has a pair of mechanisms operable to move the seating unit between the closed position and the extended position, with one mechanism coupled to each base plate. Each mechanism is a mirror-image of the other. Each mechanism has a seat plate pivotally coupled to a corresponding base plate with a first linkage that moves the seat plate between a first position when the seating unit is in the closed position and a second position when the seating unit is in the extended position. Each mechanism further includes a back mounting link that is pivotally coupled to the seat plate and to a second linkage that reclines the back mounting link from a first, upright position when the seating unit is in the closed position to a second, reclined position when the seating unit is in the extended position. In the reclined position, the back mounting link is reclined slightly relative to the seat plate to provide a different recline position as compared to a seating unit where the back is fixed relative to the seat. A footrest linkage is pivotally coupled to the seat plate that moves the footrest from a stowed position when the seating unit is in the closed position to an open position when the seating unit is in the extended position. A third linkage is coupled to the footrest linkage that moves the footrest linkage between the stowed position and the open position. A bell crank is pivotally coupled to the seat plate. The bell crank has a first section extending in a first direction from the pivotal connection with the seat plate, and a second section extending in a second direction from the pivotal connection with the seat plate. The first section of the bell crank is pivotally connected to a link in the third linkage, and the second section is pivotally connected to a link in the third linkage and to a link in the second linkage. The bell crank controls (directly or indirectly) the extended position of the footrest and the reclined position of the back.

Figure 1:
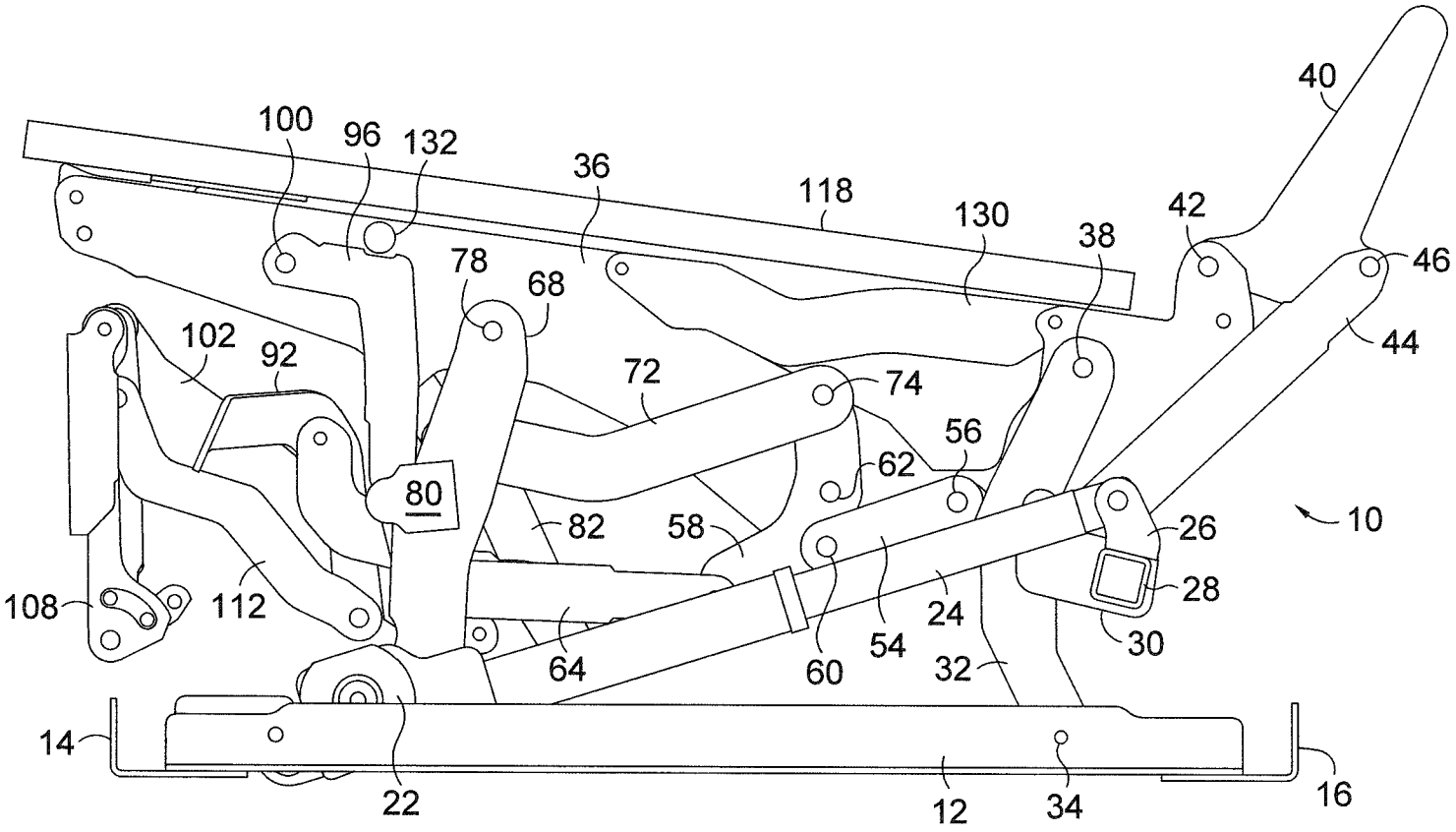
FIG. 1 is a cross sectional view of an exemplary chair with a mechanism in a closed position, showing one side of a mechanism, in accordance with an embodiment of the invention.
Figure 2:
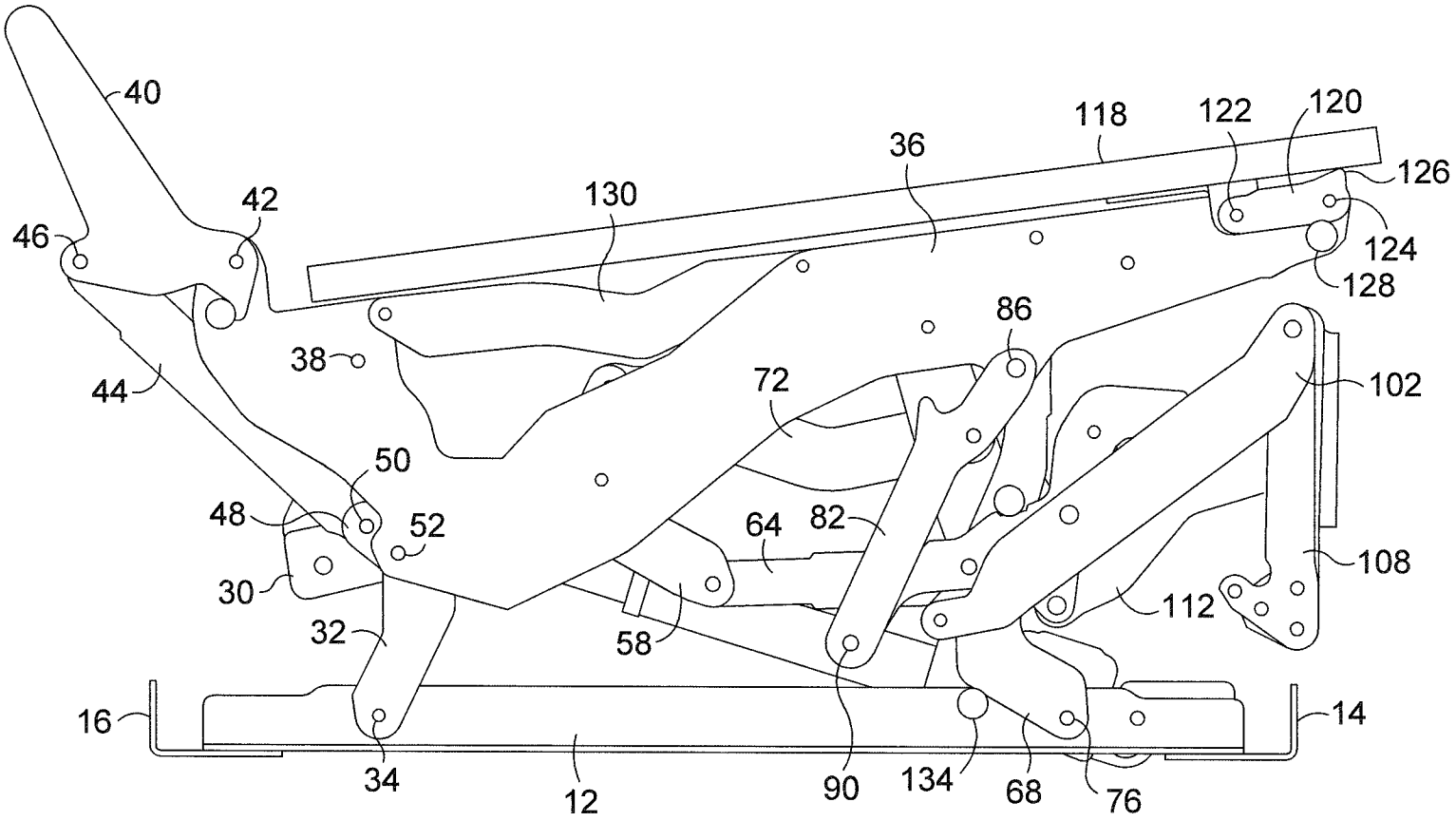
FIG. 2 is a view similar to FIG. 1, but from the opposite side.
Figure 3:
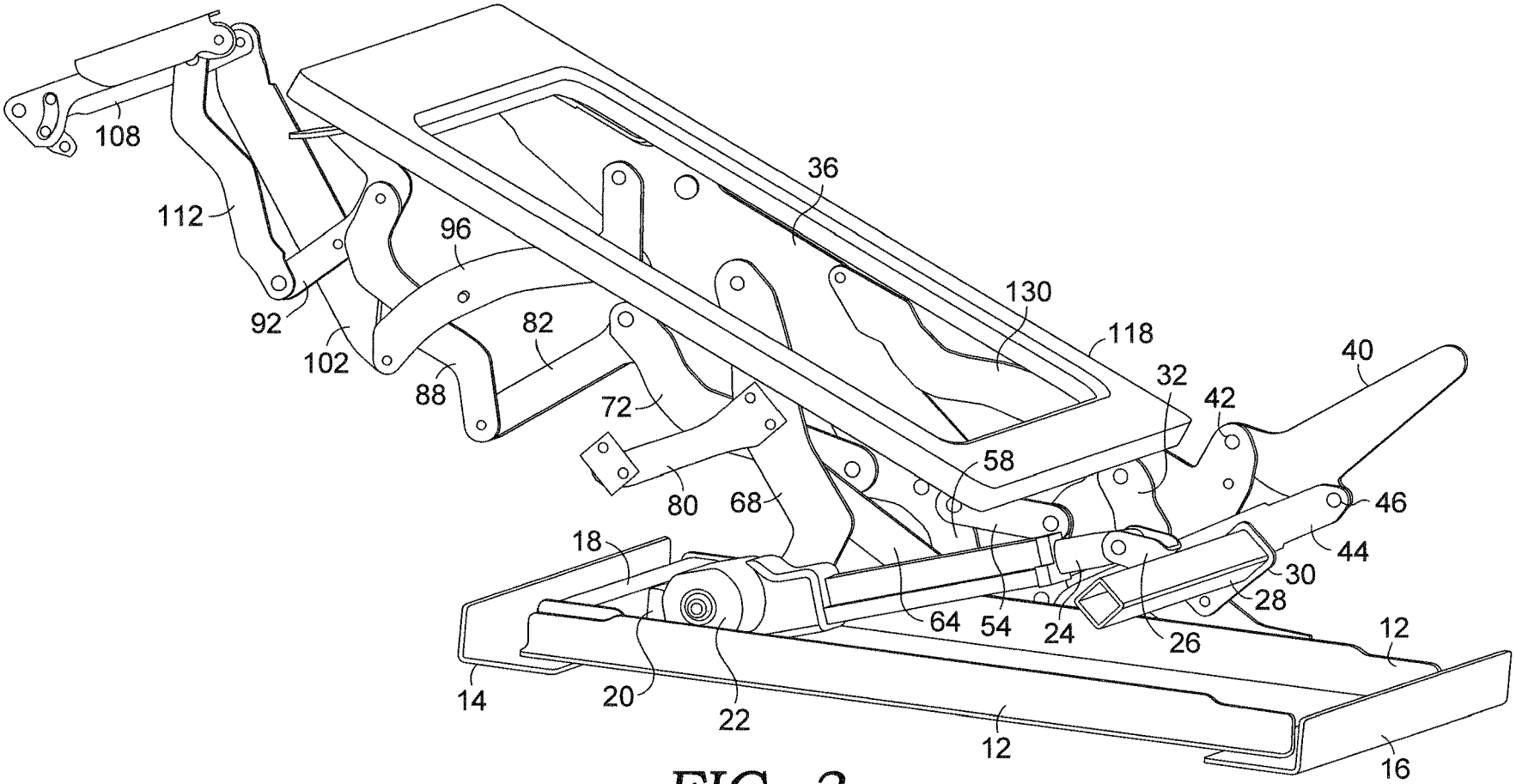
FIG. 3 is a partial perspective view, with parts removed for clarity, showing the fully reclined position.
Figure 4:
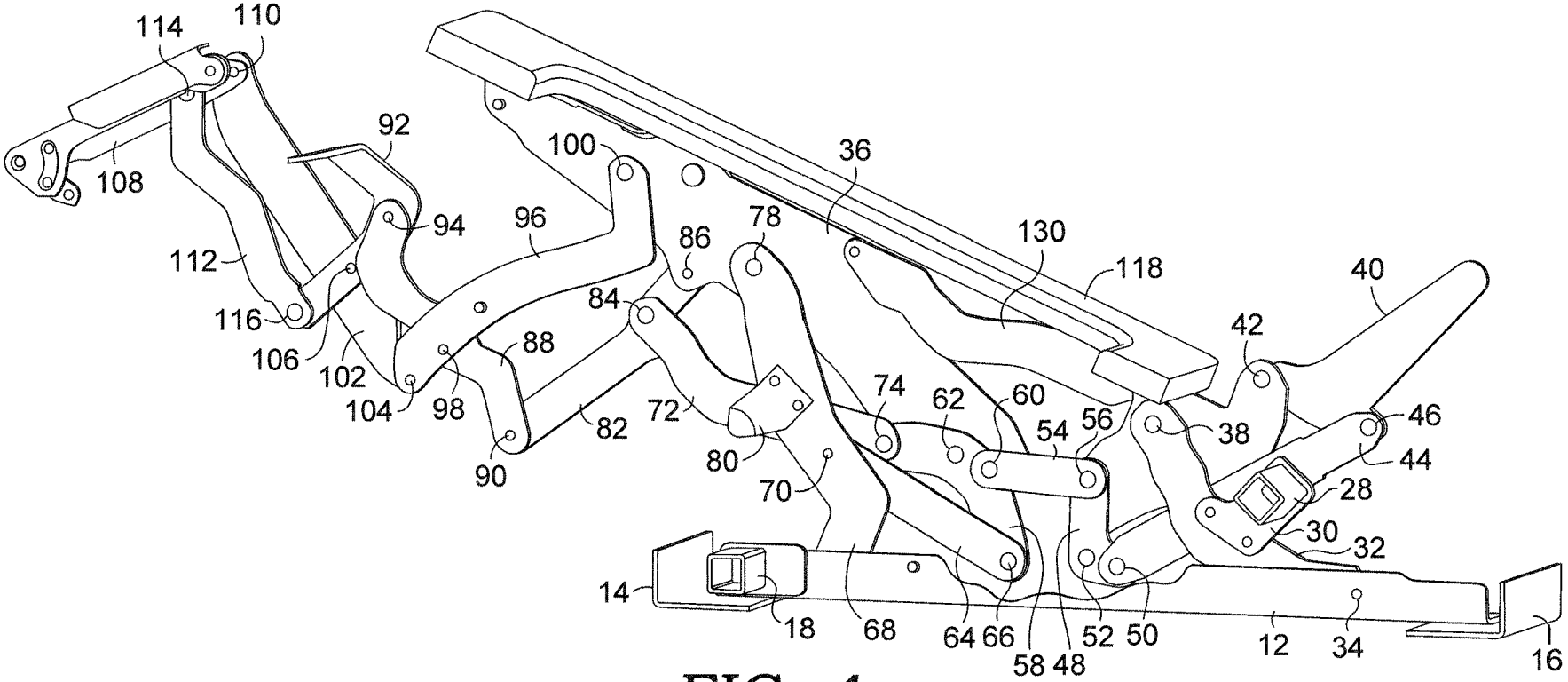
FIG. 4 is a view similar to FIG. 3, but taken along a section closer to the side to better show the linkages.
Figure 5:
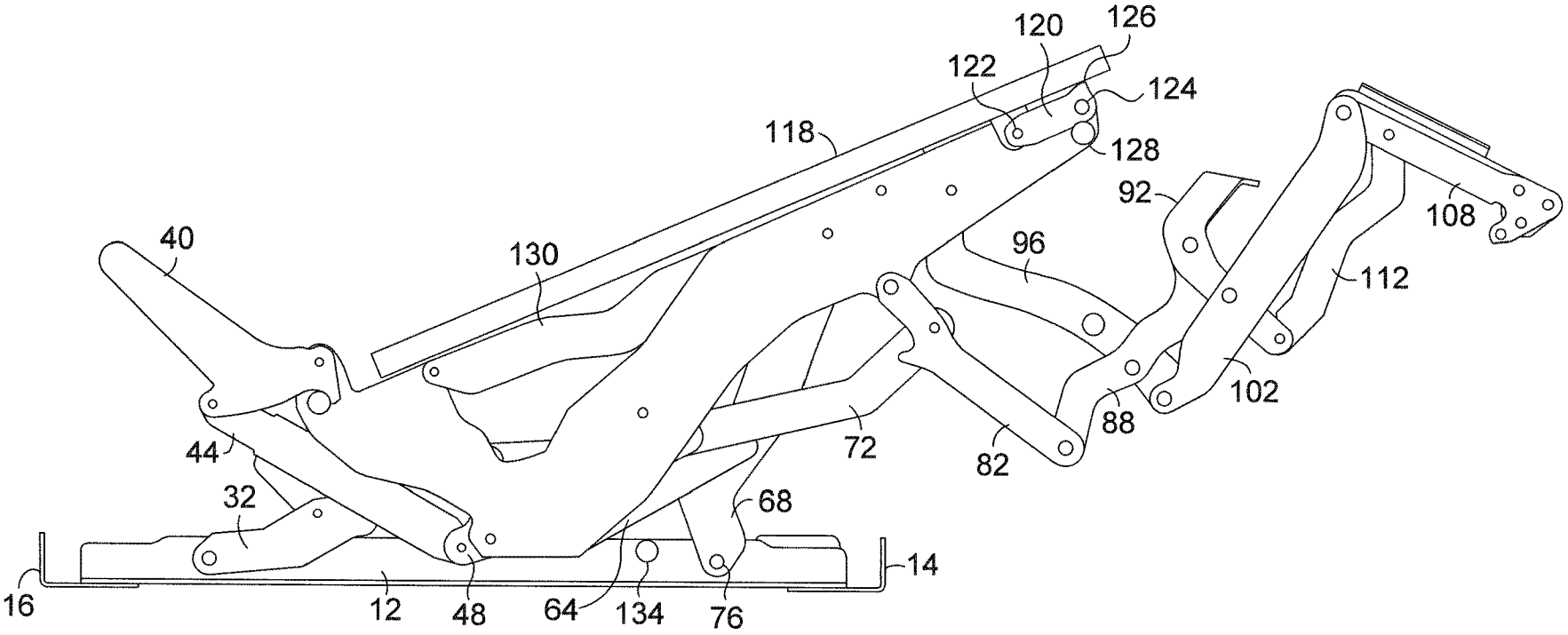
FIG. 5 is a side view of the mechanism of FIG. 4 from the opposite side.

A seating mechanism 10 is shown in a closed position in FIGS. 1 and 2, and in an extended, zero-gravity position in FIGS. 3-5. As best seen in FIG. 2, the seating mechanism 10 has a pair of spaced apart side base plates 12 that are coupled to a front rail 14 and a rear rail 16. The side base plates 12, front rail 14, and rear rail 16 form a base for the seating mechanism 10. A front motor tube 18 is coupled to, and extends between, the side base plates 12. A clevis 20 is coupled to the front motor tube 18, part way along front motor tube 18, and generally centered thereon. Clevis 20 is used to pivotally couple a motor 22 to the front motor tube 18. Motor 22 has an extendable shaft 24 that is pivotally coupled on its outer end to a clevis 26. Clevis 26 is, in turn, coupled to a rear motor tube 28. Rear motor tube 28 extends from one side of seating mechanism 10 to the other, and is coupled on each outer end to a motor tube bracket 30. Front motor tube 18 and rear motor tube 28 are shown made from square, steel tubing, but other materials could also be used. Also, while not shown, it should be understood that motor 22 is coupled to a power source so that the motor 22 can extend and retract shaft 24 upon operation of controls, such as a push button or toggle switch.

Turning to FIG. 4, only one side of the mechanism 10 is shown. Each side of mechanism 10 is a mirror-image of the other side, and so only one side is described below. The motor tube bracket 30 is fixedly coupled to a rear pivot link 32. Rear pivot link 32 is pivotally coupled on one end to side base plate 12 at pivot point 34. Rear pivot link 32 extends from pivot point 34 and is pivotally coupled on its other end to a seat plate 36 at pivot point 38. The rear end of seat plate 36 is pivotally coupled to a back mounting link 40 at pivot point 42. Back mounting link 40 is used to couple a chair back to the seating mechanism 10, as would be understood by those of skill in the art. Back mounting link 40 is pivotally coupled to a back support link 44 at pivot point 46. Back support link 44 extends away from pivot point 46, and is pivotally coupled on an opposite end to a back bell crank 48 at pivot point 50. Note that a portion of side base plate 12 is removed in FIG. 4 to reveal this connection. Back bell crank 48 is pivotally coupled to seat plate 36 at pivot point 52. Back bell crank 48 has somewhat of an L-shape, with one leg pivotally connected to the back support link 44 (at pivot point 50), and with the other leg pivotally connected to a rear control link 54 at pivot point 56. Rear control link 54 is a short, linear link with an end opposite pivot point 56 that is pivotally connected to a bell crank 58 at pivot point 60.

Bell crank 58 has a boomerang shape, and is pivotally coupled to the seat plate 36 at pivot point 62, near the center of bell crank 58. One end of bell crank 58 is pivotally coupled to a front pivot toggle 64 at pivot point 66. The end of front pivot toggle 64 opposite pivot point 66 is pivotally coupled to a front pivot link 68 at pivot point 70. The end of bell crank 58 opposite pivot point 66 is pivotally coupled to a footrest drive link 72 at pivot point 74. Front pivot link 68 is pivotally coupled at its lower end to side base plate 12 at pivot point 76. Front pivot link 68 extends upwardly from the side base plate 12, and is pivotally coupled at its upper end to seat plate 36 at pivot point 78. As best seen in FIG. 3, a cross tube 80 is fixedly coupled to front pivot link 68 near the midpoint of front pivot link 68. Cross tube 80 extends from one side of mechanism 10 to the other, coupled at each end to a corresponding front pivot link 68. Cross tube 80 adds stability to mechanism 10.

Footrest drive link 72 extends from pivot point 74 and is pivotally coupled on its other end to a rear ottoman link 82 at pivot point 84. Rear ottoman link 82 is pivotally coupled on its upper end to seat plate 36 at pivot point 86 and is pivotally coupled on its lower end to a rear extension link 88 at pivot point 90. The end of rear extension link 88 opposite pivot point 90 is pivotally coupled to a mid-ottoman bracket 92 at pivot point 94. Generally mid-way along rear extension link 88, the rear extension link 88 is pivotally coupled to a front ottoman link 96 at pivot point 98. The upper end of front ottoman link 96 is pivotally coupled to seat plate 36 at pivot point 100. The lower end of front ottoman link 96 is pivotally coupled to a first ottoman link 102 at pivot point 104. First ottoman link 102 extends from pivot point 104 and is pivotally coupled to mid-ottoman bracket 92 at pivot point 106. The outer end of first ottoman link 102 is pivotally coupled to an ottoman bracket 108 at pivot point 110. Ottoman bracket 108 may be constructed with a spring-loaded release design, as is known to those of skill in the art. A second ottoman link 112 is pivotally coupled on one end to ottoman bracket 108 at pivot point 114, and is pivotally coupled on the other end to an outer end of mid-ottoman bracket 92 at pivot point 116. While not shown, a stabilizer tube may be coupled to the end of mid-ottoman bracket 92 opposite pivot point 116, extending between the mid-ottoman bracket 92 on each side of mechanism 10 to provide added stability to mechanism 10.

Figure 6:
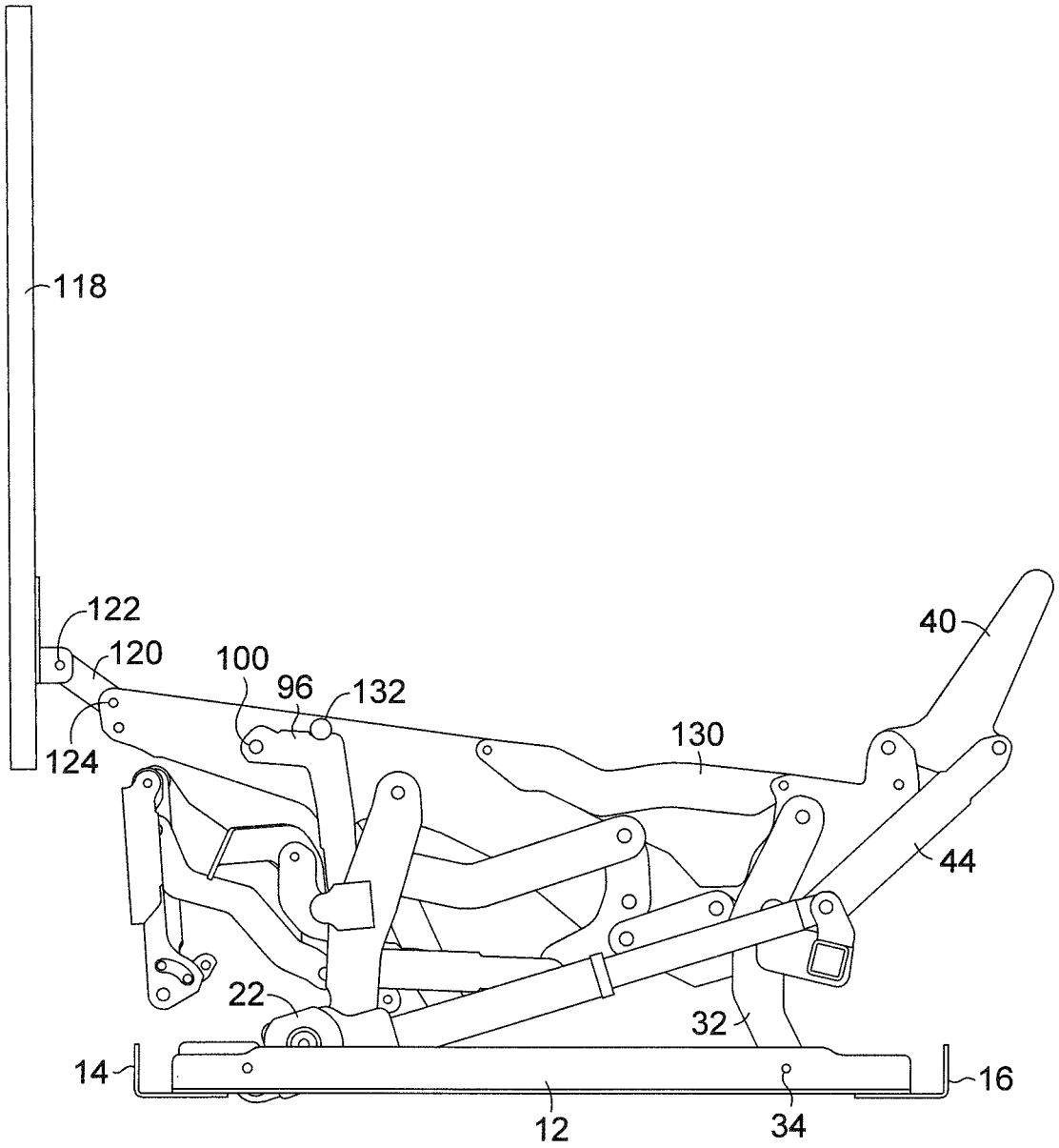
FIG. 6 is a view similar to FIG. 1 showing the seat frame rotated to the up position.

As best seen in FIG. 5 a seat frame 118 is pivotally coupled to a seat pivot link 120 at pivot point 122. The seat pivot link 120 is also pivotally coupled to seat plate 36 at pivot point 124. As best seen in FIG. 5, the seat pivot link 120, near pivot point 124, has a stop bump 126 that extends from the perimeter of the seat pivot link 120. A stop pin 128 is fixed to seat plate 36 just below pivot point 124. The seat pivot link 120 allows the seat frame 118 to be pivoted upwardly, from the position shown in FIG. 5, to the position shown in FIG. 6. The stop pin 128 engages the stop bump 126 to prevent over-rotation of the seat frame 118. Additionally, in the position with the seat frame 118 rotated up (FIG. 6), the forward edge of the seat engages the top of a footrest on ottoman bracket 108 to prevent over-rotation of seat frame 118.

As best seen in FIGS. 1 and 4, an upper seat bracket 130 is coupled to seat plate 36. Upper seat bracket 130 extends over a gap in the seat plate 36, providing an additional surface for seat frame 118 to rest against and ensuring that seat frame 118 does not drop into the gap in the seat plate 36.

A number of additional stop pins are used to stop mechanism 10 from moving beyond a desired position. As best seen in FIG. 1, a stop pin 132 is coupled to seat plate 36 that engages part of front ottoman link 96 when the mechanism 10 is moved to the closed position, which stops the rotation of front ottoman link 96 at a desired position. Similarly, a stop pin 134 is coupled to side base plate 12, as best seen in FIG. 2. Stop pin 134 engages a bottom part of front pivot link 68 and stops the rotation of front pivot link 68 when the mechanism 10 reaches the closed position.

The mechanism 10 moves the seat from a closed position (FIG. 1) to an open, zero-gravity position (FIG. 4). The seat plate 36 is moved from the closed position to the open position by engaging motor 22 to retract shaft 24. As shaft 24 retracts, the rear motor tube 28 acts through the motor tube bracket 30 to rotate rear pivot link 32 counter-clockwise (as viewed from the perspective of FIG. 4) about pivot point 34. This moves seat plate 36 forwardly and downwardly, as controlled by front pivot link 68 and rear pivot link 32. In moving to the open position, the seat on seat frame 118 moves forwardly carried by seat plate 36, and the back of seat frame 118 drops, so that the seat is more inclined from back to front. As the seat plate 36 moves forwardly, the ottoman bracket 108 moves from a stowed position to the open position shown in FIG. 4, driven by bell crank 58 and footrest drive link 72. The final open position of ottoman bracket 108 is inclined at an opposite angle from seat frame 118 to achieve part of the zero-gravity position. This final open position of ottoman bracket 108 is achieved by the rotation of bell crank 58, which is controlled by the movement of seat plate 36, and the front pivot toggle 64 (connected to the front pivot link 68) and the footrest drive link 72 (connected to the rear ottoman link 82). In moving from the closed position to the open position, the bell crank 58 rotates counter-clockwise about pivot point 62. This motion moves rear control link 54, which in turn causes back bell crank 48 to rotate clockwise about pivot point 52. The rotational movement of back bell crank 48 pulls back support link 44, causing back mounting link 40 to recline slightly as the mechanism 10 moves from the closed position to the open position, rotating about pivot point 42. In this zero-gravity open position, the back mounting link 40 slightly reclines the back (attached to back mounting link 40) relative to the seat frame 118 resulting in a comfortable zero-gravity position for someone sitting in a chair having seating mechanism 10.

From the foregoing, it will be seen that this invention is one well adapted to attain all the ends and objects hereinabove set forth together with other advantages, which are obvious and inherent to the structure. It will be understood that certain features and subcombinations are of utility and may be employed without reference to other features and subcombinations. This is contemplated by and is within the scope of the claims. Since many possible embodiments may be made of the invention without departing from the scope thereof, it is to be understood that all matter herein set forth or shown in the accompanying drawings is to be interpreted as illustrative and not in a limiting sense.

The invention claimed is:

1. A mechanism for a seating unit having a footrest, a seat, and a back, the mechanism adapted to move the seating unit from a closed position with the footrest stowed beneath the seat, the seat in a generally horizontal orientation, and the back in an upright position, to an extended position with the footrest extended, the seat inclined from back-to-front, and the back in a reclined position, the mechanism comprising:

a pair of spaced apart first and second base plates, coupled together in spaced relation, each base plate having a front end and a rear end; and a pair of mechanisms operable to move the seating unit between the closed position and at the extended position, with one mechanism coupled to each base plate, each mechanism comprising:

a seat plate pivotally coupled to one of the base plates with a first linkage that moves the seat plate between a first position when the seating unit is in the closed position and a second position when the seating unit is in the extended position;

a back mounting link pivotally coupled to the seat plate and to a second linkage that reclines the back mounting link from a first, upright position when the seating unit is in the closed position to a second, reclined position when the seating unit is in the extended position;

a footrest linkage pivotally coupled to the seat plate that moves the footrest from a stowed position when the seating unit is in the closed position to an open position when the seating unit is in the extended position;

a third linkage, coupled to the footrest linkage, wherein the third linkage moves the footrest linkage between the stowed position and the open position; and a bell crank pivotally coupled to the seat plate, the bell crank having a first section extending in a first direction from the pivotal connection with the seat plate, and a second section extending in a second direction from the pivotal connection with the seat plate, wherein the first section is pivotally connected to a link in the third linkage, and wherein the second section is pivotally connected to a link in the third linkage and to a link in the second linkage.

2. The mechanism of claim 1, wherein the second linkage comprises:

a back support link having first and second ends, the back support link pivotally coupled on a first end to the back mounting link;

a back bell crank pivotally coupled to the seat plate, and having a first section and second section, the second section of the back bell crank pivotally coupled to the second end of the back support link; and a rear control link having first and second ends, the first end of the rear control link pivotally coupled to the first section of the back bell crank, and the second end of the rear control link pivotally coupled to the second section of the bell crank, wherein the second linkage controls the recline of the back mounting link as the mechanism moves from the closed position to the extended position.

3. The mechanism of claim 2, wherein the first linkage comprises:

a front pivot link pivotally coupled on a first end to one of the base plates and pivotally coupled on a second end to the seat plate; and a second pivot link pivotally coupled on a first end to one of the base plates and pivotally coupled on a second end to the seat plate.

4. The mechanism of claim 3, wherein the third linkage comprises:

a footrest drive link having first and second ends, the first end of the footrest drive link pivotally coupled to a link on the footrest linkage and the second end of the footrest drive link pivotally coupled to the first section of the bell crank; and a front pivot toggle having first and second ends, the first end of the front pivot toggle pivotally coupled to the front pivot link and the second end of the front pivot toggle pivotally coupled to the second section of the bell crank.

5. The mechanism of claim 4, wherein the first linkage and the bell crank limit the open position of the footrest linkage to a position where the footrest stops short of a horizontal position with a front of the footrest lower than the rear of the footrest.

6. The mechanism of claim 5, wherein the second linkage and the bell crank control the back mounting link to recline the back mounting link as the seating unit moves from the closed to the extended position.

7. The mechanism of claim 6, further comprising a seat frame pivotally coupled to the front of the seat plate.

8. The mechanism of claim 7, further comprising a seat pivot bracket having first and second ends, wherein the first end of the seat pivot bracket is pivotally coupled to the seat frame and wherein the second end of the seat pivot bracket is pivotally coupled to the seat plate.

9. The mechanism of claim 6, further comprising;

a rear motor tube coupled to, and between, the rear pivot link on each side of the mechanism;

a front motor tube coupled to, and between, the spaced apart base plates; and a motor having an extending shaft, the motor pivotally coupled to the front motor tube, and the extending shaft pivotally coupled to the rear motor tube.

10. A seating unit having a footrest, a seat, and a back, moveable between a closed position with the footrest stowed beneath the seat, the seat in a generally horizontal orientation, and the back in an upright position, and an extended position with the footrest extended, the seat inclined from back-to-front, and the back in a reclined position, the seating unit having a mechanism comprising:

a pair of spaced apart first and second base plates, coupled together in spaced relation, each base plate having a front end and a rear end; and a pair of mechanisms operable to move the seating unit between the closed position and the extended position, with one mechanism coupled to each base plate, each mechanism comprising:

a seat plate pivotally coupled to one of the base plates with a first linkage that moves the seat plate between a first position when the seating unit is in the closed position and a second position when the seating unit is in the extended position;

a back mounting link pivotally coupled to the seat plate and to a second linkage that reclines the back mounting link from a first, upright position when the seating unit is in the closed position to a second, reclined position when the seating unit is in the extended position;

a footrest linkage pivotally coupled to the seat plate that moves the footrest from a stowed position when the seating unit is in the closed position to an open position when the seating unit is in the extended position;

a third linkage, coupled to the footrest linkage, wherein the third linkage moves the footrest linkage between the stowed position and the open position; and a bell crank pivotally coupled to the seat plate, the bell crank having a first section extending in a first direction from the pivotal connection with the seat plate, and a second section extending in a second direction from the pivotal connection with the seat plate, wherein the first section is pivotally connected to a link in the third linkage, and wherein the second section is pivotally connected to a link in the third linkage and to a link in the second linkage.

11. The seating unit of claim 10, wherein the second linkage comprises:

a back support link having first and second ends, the back support link pivotally coupled on a first end to the back mounting link;

a back bell crank pivotally coupled to the seat plate, and having a first section and second section, the second section of the back bell crank pivotally coupled to the second end of the back support link; and a rear control link having first and second ends, the first end of the rear control link pivotally coupled to the first section of the back bell crank, and the second end of the rear control link pivotally coupled to the second section of the bell crank, wherein the second linkage controls the recline of the back mounting link as the mechanism moves from the closed position to the extended position.

12. The seating unit of claim 11, wherein the first linkage comprises:

a front pivot link pivotally coupled on a first end to one of the side plates and pivotally coupled on a second end to the seat plate; and a second pivot link pivotally coupled on a first end to one of the side plates and pivotally coupled on a second end to the seat plate.

13. The seating unit of claim 12, wherein the third linkage comprises:

a footrest drive link having first and second ends, the first end of the footrest drive link pivotally coupled to a link on the footrest linkage and the second end of the footrest drive link pivotally coupled to the first section of the bell crank; and a front pivot toggle having first and second ends, the first end of the front pivot toggle pivotally coupled to the front pivot link and the second end of the front pivot toggle pivotally coupled to the second section of the bell crank.

14. The seating unit of claim 13, wherein the first linkage and the bell crank limit the open position of the footrest linkage to a position where the footrest stops short of a horizontal position with a front of the footrest lower that the rear of the footrest.

15. The seating unit of claim 14, wherein the second linkage and the bell crank control the back mounting link to recline the back mounting link as the seating unit moves from the closed to the extended position.

16. The seating unit of claim 15, further comprising a seat frame pivotally coupled to the front of the seat plate.

17. The seating unit of claim 16, further comprising a seat pivot bracket having first and second ends, wherein the first end of the seat pivot bracket is pivotally coupled to the seat frame and wherein the second end of the seat pivot bracket is pivotally coupled to the seat plate.

18. The seating unit of claim 17, further comprising;

a rear motor tube coupled to, and between, the rear pivot link on each side of the mechanism;

a front motor tube coupled to, and between, the spaced apart base plates; and a motor having an extending shaft, the motor pivotally coupled to the front motor tube, and the extending shaft pivotally coupled to the rear motor tube.

* * * * *